US005785131A

United States Patent [19]

Gray

[11] Patent Number: 5,785,131

[45] Date of Patent: Jul. 28, 1998

[54] PRESSURIZED FORMATION SAMPLE COLLECTION

[76] Inventor: Ian Gray, 48 Marriott Street, Coorparoo, Queensland 4151, Australia

[21] Appl. No.: 617,160

[22] Filed: Mar. 18, 1996

[30] Foreign Application Priority Data

Mar. 20, 1995 [AU] Australia ..... PN824

[51] Int. Cl.[6] ..... E21B 49/00

[52] U.S. Cl. ..... 175/46; 175/59; 175/60; 175/214

[58] Field of Search ..... 175/46, 60, 59, 175/66, 205, 212, 214, 218, 207, 206; 166/91.1

[56] References Cited

U.S. PATENT DOCUMENTS

| | | | |
|---|---|---|---|
| Re. 26,220 | 6/1967 | Records | 175/205 |
| 2,786,652 | 3/1957 | Wells | 175/212 |
| 3,291,229 | 12/1966 | Houston | 175/60 |
| 3,354,970 | 11/1967 | Lummus | 175/218 |
| 3,362,487 | 1/1968 | Lindsey | 166/91.1 X |
| 3,827,511 | 8/1974 | Jones | 166/91.1 |
| 3,968,845 | 7/1976 | Chaffin | 175/60 |
| 4,063,427 | 12/1977 | Hoffman | 166/187 X |
| 5,010,966 | 4/1991 | Stokley et al. | 175/66 |

OTHER PUBLICATIONS

S. Rahman et al., "Drilling a Horizontal Well Through Coal Seams While Maintaining a Constant Wellbore Pressure", *The Australian Coal Journal*, No. 31, pp. 33–42; 1991.

*Primary Examiner*—Hoang C. Dang

*Attorney, Agent, or Firm*—Nixon & Vanderhye, P.C.

[57] ABSTRACT

A borehole drilling apparatus has a jacket attachable to a well head and through which a drill rod passes and which carries pressurized drilling fluid to a working end of the drill rod and out into an annulus of the borehole. The jacket has a drill rod seal and an outlet port leading from the interior of the jacket to a pressure regulator. The pressure regulator comprises an annular space through which fluid can flow from an inlet to an outlet. The annular space is defined between an inner rod and a surrounding elastomer pipe. In use, the elastomer pipe is squeezed radially inwards toward the inner rod by fluid pressure maintained between the outside of the elastomer pipe and a surrounding housing. A sampling system is in communication with the outlet port at a location upstream of the regulator. The sampling system intercepts a proportion of the drilling fluid passing to the regulator for enabling sorption pressures, gas contents, bubble points or other characteristics of the return fluid and entrained contents to be determined.

8 Claims, 8 Drawing Sheets

PRESSURIZED FORMATION SAMPLE COLLECTION

This invention relates to collecting at pressure, samples of drilled formations and in particular an assembly and method for collecting such samples in a manner permitting determination of such characteristics thereof as gas content, formation gas sorption pressure or formation fluid bubble point.

RELATED ART AND OTHER CONSIDERATIONS

A precursor to many mining operations is the drilling of boreholes for exploration and development purposes of, for example, coal or oil. The drilled boreholes are generally either vertical or horizontal. Horizontal wells are often drilled at the bottom of mine shafts or in the walls of open cut operations. In coal mining operations horizontal boreholes are most often drilled for either core sampling purposes or methane gas drainage.

The drilling of boreholes, particularly horizontal boreholes, faces a number of problems. One of these occurs where the fluid formation pressure exceeds that of the drilling fluid in the borehole annulus. This problem may lead to borehole collapse with an associated release of large volumes of cuttings or drill rod entrapment. To overcome these problems in vertical holes the conventional approach is to increase the density of the drilling fluid and to incorporate an agent which will form a filter cake on the borehole wall. This creates positive not fluid pressure which bears against the borehole wall and supports it. In the absence of vertical depth, as is the case in a sub-horizontal borehole, the approach of using a dense drilling fluid will not work and another system to raise the borehole fluid circulating pressure must be used.

Maintaining fluid pressure in the borehole has the additional advantage that provided the pressure is maintained above sorption pressure, or the bubble point, then gas will not be emitted into the drilling fluid. Thus the only gas release from the borehole will be in the form of gas sorption into the fragments of material being drilled or contained in solution in formation fluid that is withdrawn as part of the drilling process. This has significant advantages in terms of safety that include drilling in the absence of sudden expulsions of gas (gas kicks) and drilling without significant gas production. A high fluid pressure that excludes bubbles in the drilling fluid will also facilitate the use of geophysical monitoring using such techniques as resistivity, seismic and density logging. These tools will not work in a changing fluid such as occurs when gas and drilling fluid flow in the annulus.

An assembly for maintaining a constant borehole pressure has been described by Rahman and Marx in "Drilling a Horizontal Well Through Coal Seams While Maintaining a Constant Wellbore Pressure" published in The Australian Coal Journal, No. 31, 1991. The Rahman and Marx assembly was designed to allow a core sample to be taken using a wireline coring tool while maintaining a constant wellhead pressure. The major components of the Rahman and Marx assembly are a rotating and feeding device, a pressure hose, a circulating system, a coring device, and an hydraulic system. The rotating and feeding device comprises a hydraulically operated rail-mounted drilling head. The rotating head was custom built and incorporated a collect chuck and hollow cylindrical spindle. The pressure hose incorporated a bucket preventer, a rotating preventer, two ball valves and two tongs. The ball valves were operated to isolate sections of the device so that the borehole pressure could be maintained whilst making and breaking the drill pipes. The circulating system was fairly conventional except for the development of a pressure regulator valve coupled to an auxiliary piston pump and designed to make up for any pressure loss that might occur in the system. The coring device was a conventional wireline coring tool commonly used by the drilling industry. The device was modified to incorporate a back pressure valve into the inner core barrel to enable the system pressure to be maintained while running and receiving the inner core barrel.

Although the Rahman and Marx assembly achieved a relatively constant borehole pressure it was unduly complex. The apparatus relied upon a collection of ball valves for isolating and maintaining pressure in sections of the device. Furthermore, drilling operations had to stop to allow collection of core samples.

One purpose of collecting core samples is to detect the gas sorption pressure of the formation being drilled. The most common application is in coal exploration where the methane content of the coal is determined from desorption (out-gassing) measurements. Sorption pressure is the most important single measurement in assessing outburst risk and also strongly influences how a seam will drain.

The technique generally used to assess the sorption pressure is the gas volume derived from core samples used in conjunction with laboratory measured sorption isotherms. The gas volume measurement is subject to error, especially in terms of lost gas during the time between when the core is pulled and when the measurements commence. Sorption isotherms are very variable depending on the test technique, coal type, gas composition and history. The combined errors may well lead to an error of over 50% in sorption pressure estimation. The consequences of these errors are very serious as they may lead to either an unsafe situation or to unnecessary expenditure on gas drainage.

The detailed steps involved in the above technique are described in Australian Standard AS3980-1991 titled "Guide to the determination of desorbable gas content of coal seams—Direct method". The standard summarises the presently acceptable approach in section 5 stating:

> The method consists of sampling the coal seam by coring or underground face sampling, placing the sample in a canister and putting it on test with minimum delay. The initial desorption rate is measured and used for the calculation of Q1. The total quantity of gas evolved from the canister is measured volumetrically to determine Q2
>
> Sub-samples are then taken from the canister and crushed, at approximately atmospheric pressure, in a ball mill, until the gas evolution ceases. The quantity of gas evolved by crushing is measured to determine residual gas Q3.
>
> The amount of gas lost Q1 is determined by extrapolation of the desorption trend to zero time. The total desorbable gas content QTD is then calculated.

The inaccuracies of the standard technique are well-known and much effort has been put into determining correction factors and modifying standard practices. A recent paper by Ryan and Dawson in Geological Fieldwork, 1993 paper 1994-1 discusses in detail the various methodologies available for sorption data collection. It is clear from the findings of Ryan and Dawson and from the inventor's own experience that a more accurate method of determining the sorption pressure of drilled material is desirable.

Pressurised core barrels (as described by P W Brent in Reheat Cores to Measure Gas Better, Petroleum Engineer International, October 1991) offer an alternative to obtain sorption pressure. Pressurised core barrels will not however work in a horizontal drilling situation where fluid pressure does not prevent the gas being released during drilling. Other systems exist for the measurement of sorption pressures; however, they are not suitable for use in horizontal boreholes and can only be used by interrupting drilling operations.

SUMMARY

Apparatus for permitting sampling of borehole drilling fluid at a pressure above that otherwise existing at a wellhead comprising:

a jacket attachable to the wellhead and through which in use can pass a drill rod which carries pressurised drilling fluid to the working end of the drill rod and out into the annulus of the borehole, the jacket having a drill road seal at a location spaced from the wellhead and an outlet port leading from the interior of the jacket to a pressure regulator, whereby return fluid with any entrained particles or formation fluid from a drilled formation passes back into the jacket and on out through the outlet port and the pressure regulator and thence to waste, wherein in communication with the outlet port at a location upstream of the regulator is a sampling system for interception a proportion of the drilling fluid passing to the regulator for enabling sorption pressures, gas contents, bubble points or other characteristics of the return fluid and entrained contents to be determined.

The return fluid sampling system preferably comprises an inlet valve leading into a pressure vessel containing gause on which particles entrained in the fluid can be retained, and also comprising an outlet valve a bleed valve and pressure sensing system.

The jacket may a the wellhead end contain a resilient member which can be compressed to engage and form an inner seal around the drill rod.

The entire borehole may be shut in by use of the inner seal to permit servicing of all components on the outside of the inner seal and particularly such wearing items as the regulator element and drill rod seal.

The apparatus may include auxiliary ducting permitting the drill rod to be changed whilst maintaining drilling fluid flow into the jacket and out through the regulator thus freeing the need for the regulator to shut down on chip laden return drilling fluid and thus extending the life of the regulator element.

According to another aspect of the invention an apparatus for supplying pressurised hydraulic fluid to a drill in a borehole and maintaining the pressure thereof, the assembly comprises:

a jacket with an aperture therein providing a passage for receiving a drilling rod with a hydraulic supply passage therein for supplying pressurised hydraulic fluid to a drill casing in the borehole, wherein when the rod is received the aperture is partitioned into an outer passage and the supply passage;

a drill rod seal adapted to engage an outer surface of the drilling rod thereby providing a seal in the outer passage for preventing the pressurised hydraulic fluid from flowing out of a first end thereof, a second end thereof being adapted to provide communication between the outer passage and the borehole;

a hydraulic pressure maintaining means associated with said outer passage and adapted to maintain hydraulic pressure in the borehole upon the cessation of the supplying of the pressurised hydraulic fluid in the supply passage; and an hydraulic outlet port in communication with the outer passage and having a pressure regulator for regulating fluid pressure in the outlet port and a sample collecting container in communication with the outlet port for collecting pressurised hydraulic fluid and drill formations from the borehole.

Preferably, there may pressure measuring means associated with the container.

There may be a valve to selectively release pressure in the container.

Suitably, the container may be adapted to be replaced with a similar container whilst maintaining the hydraulic pressure in both the borehole and container.

Preferably, the pressure maintaining means is an outer passage valve adapted to selectively engage the outer surface of the drilling rod to seal the second end the passage, wherein pressure is maintained in the borehole by the pressurised hydraulic fluid being captured between the outer passage valve and further valve associated with the supply passage.

In preference the outer passage valve comprises a resilient member and a piston arranged to deform the resilient member to engage the outer surface of the drilling rod.

Alternatively, or in addition to the outer passage valve, the pressure maintaining means may include an hydraulic inlet port in the jacket and in communication with the outer passage to thereby allow for the selective supplying of the pressurised hydraulic fluid thereto, wherein pressure is maintained in the borehole in combination with a further valve associated with the supply passage.

The drill rod seals previously mentioned are preferably rotatably mounted to the jacket and may slidably engage the outer surface of the drilling rod.

The drill rod seal may be rotatably mounted by a radial and thrust bearing set. Suitably, the drill rod seal is releasably mounted to the jacket.

The drill rod seal may be adjustable, thereby allowing the sealing of the outer passage against varying fluid pressures.

Suitably, the drill rod seal includes a resilient frustoconical seal, a narrower end of which faces away from the first end of the outer passage.

Whereas a known form of pressure regulator such for example as the piston actuated unit described by Rahman and Marx in The Australian Coal Journal, No 31 1991 might be used for the regulator included in the apparatus of the invention in its foregoing aspects, it is contemplated that improved regulator life may be achieved by a form of regulator believed to be inventive in itself comprising:

an inlet to an annular space between an inner rod and a surrounding elastomer tube. This elastomer tube is in turn surrounded by a (tubular) housing. The space between the elastomer and the tubular housing contains fluid maintained at a pressure so as to compress the elastomer element against the inner rod. As the inner fluid pressure rises the elastomer tube is forced out of contact with the inner rod thus permitting the passage of drilling fluid out of the jacket and in turn the lowering of the drilling fluid pressure within the jacket. The degree to which the annular gap between inner rod and elastomer tube opens depends on the out of balance pressure between the two. The device therefore acts as a regulator. Preferably the pressure in space between the elastomer tube and surrounding housing is filled with an hydraulic fluid which is pre-charged to a set pressure via an hydraulic accumulator.

The elastomer pipe of the pressure regulator may be reinforced with strengthening filaments to prevent it from being excessively distorted longitudinally and forced through the surrounding housing.

The regulator is constructed to fully shut down without imposing damaging internal strains on the elastomer due to the presence of the internal rod.

The regulator is constructed to fully shut down on chips or cuttings in the return fluid without severe damage to the elastomer by reason that these particles tend to break down during compression on to the inner rod.

According yet to another aspect of the invention, there is provided a method of determining a formation gas sorption pressure or formation bubble point, the method including the steps of:

drilling the formation with the assistance of a pressurised drilling fluid, the pressure of the fluid being above the formation solid gas sorption pressure or formation fluid bubble point;

collecting a pressurised sample of the formation and associated drilling fluid, the sample being collected at a pressure above the formation solid gas sorption pressure or formation fluid bubble point;

isolating the pressurised sample;

releasing an amount of pressure associated with the sample until the pressure thereof is below the formation gas sorption pressure or formation bubble point;

detecting a substantially stable pressure value of the sample, said stable value being indicative of the formation solid gas sorption pressure or formation fluid bubble point.

Preferably, the method is further characterised by:

reducing the pressure of the sample to a selected pressure which is lower than the stable value, the reducing being effected by releasing a volume of fluid associated with the sample; and measuring the volume of gas released.

Although the regulator described herein in this application is for the purpose of regulating drilling fluid its use is not limited to this alone. It is capable of pressure regulating most fluid flow and is particularly suited to regulating the flow of any fluid containing particulate material such as slurries, mine waste or mine backfill.

BRIEF DESCRIPTION OF THE DRAWINGS

In order for the invention to be readily understood and to be put into practical effect, reference will now be made to the accompanying drawings in which.

DETAILED DESCRIPTION OF THE DRAWINGS

Figure 1:
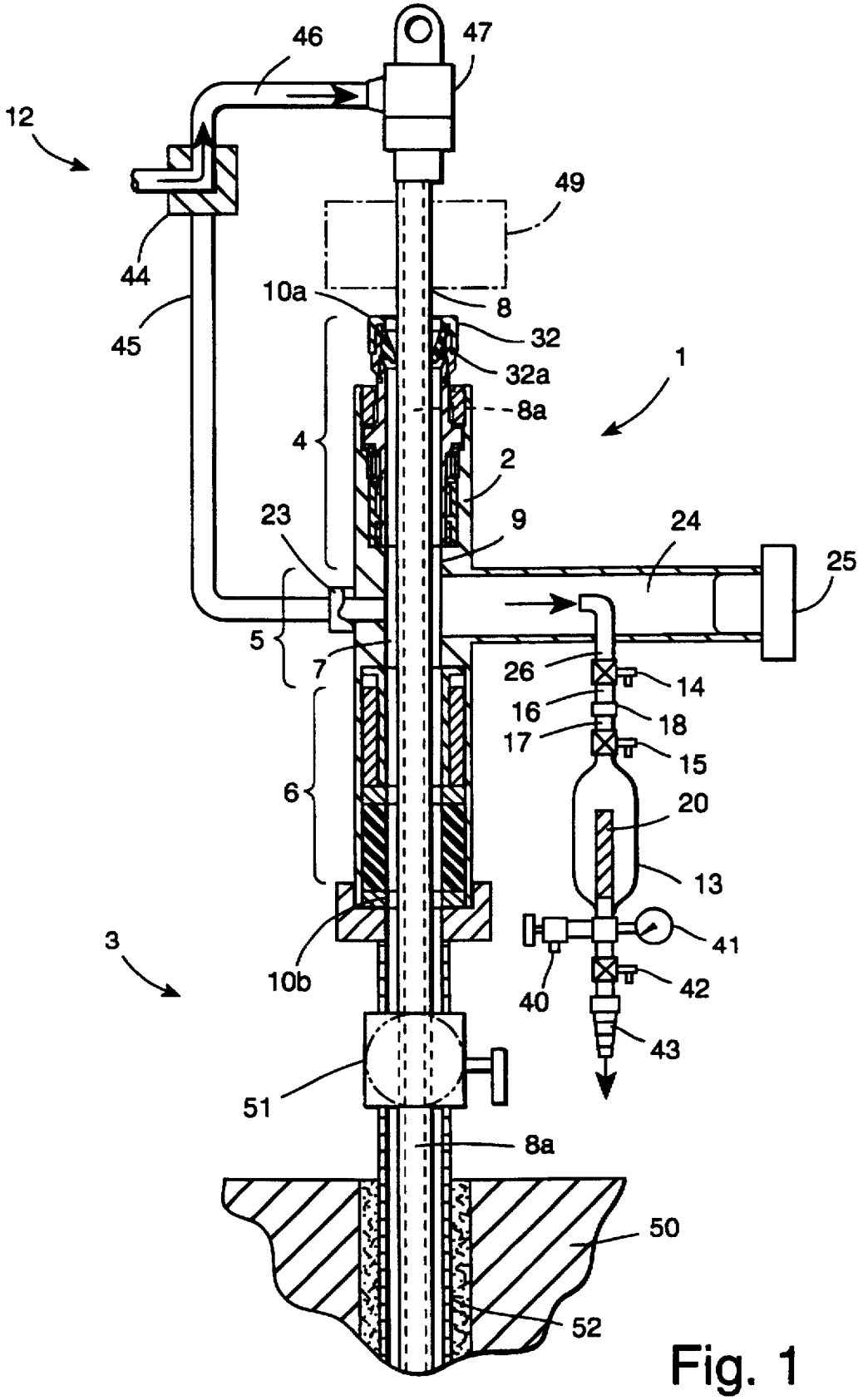
FIG. 1 is a schematic cross-sectional view of an assembly for supplying pressurised hydraulic fluid to a borehole in accordance with the invention.

Referring FIGS. 1 to 7 there is illustrated an assembly 1 mounted to a grouted drill casing 3 (often called a well head) grouted into a formation 50 to be drilled at the bottom of borehole 52. The assembly 1 is formed from three sub-assemblies, these being as first assembly section 4, intermediate assembly section 5 and second assembly section 6. When assembly sections 4, 5, 6 are assembled together there is provided a jacket 2 with an aperture 7 for receiving a drilling rod 8 having a hydraulic supply passage 8*a*. When the drilling rod 8 is received aperture 7 is partitioned into an outer passage 9 and supply passage 8*a*.

Figure 2:
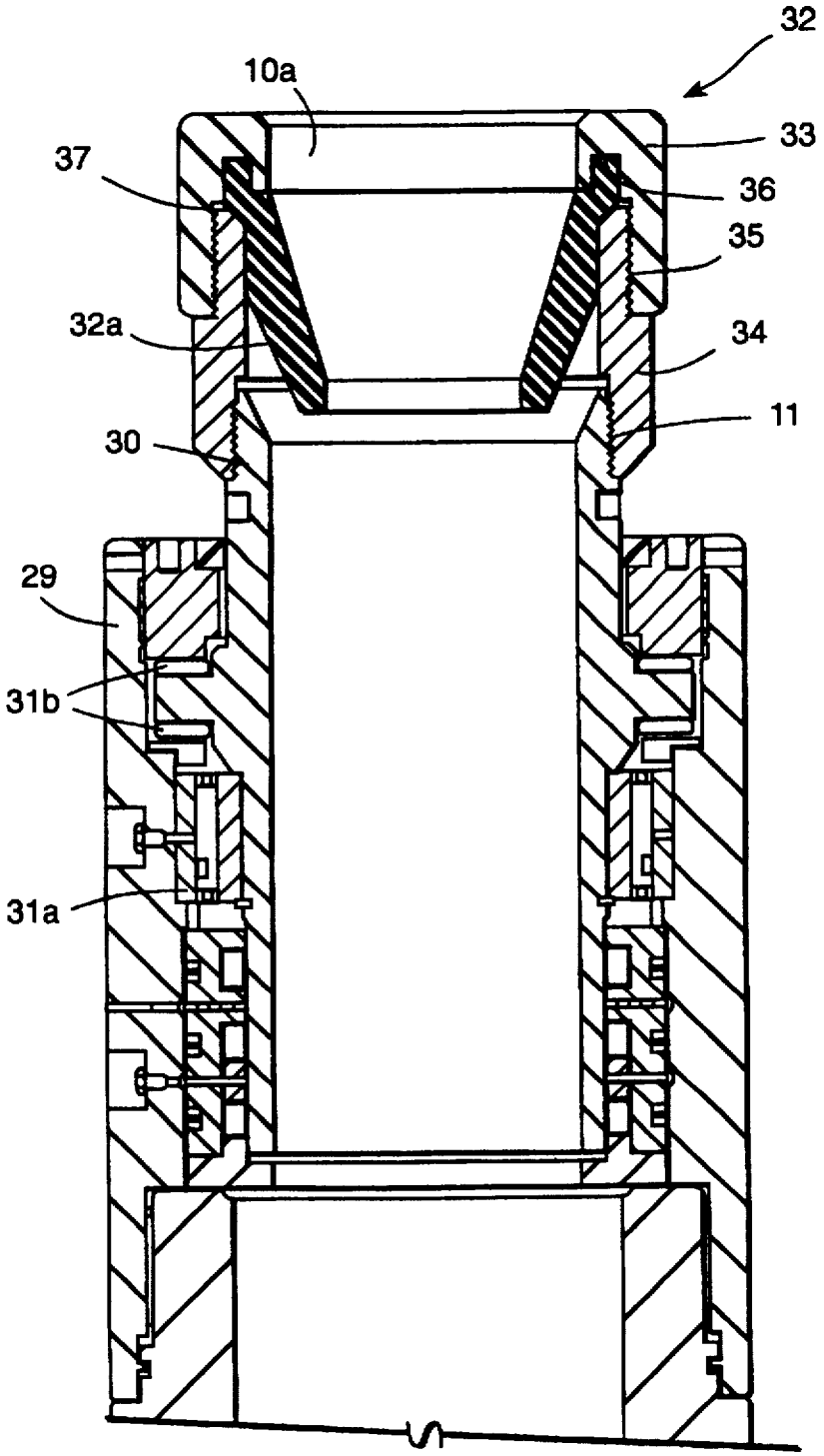
FIG. 2 is an enlarged cross-sectional view of a first assembly section of the assembly of FIG. 1.

First assembly section 4 is shown in detail in FIG. 2 and consists of a housing 29 to which a first assembly spindle 30 is rotatably mounted on a bearing assembly comprising radial bearings 31*a* and thrust needle roller bearings 31*b*. A drill rod seal 32 is removable mounted to spindle 30 by engagement of threaded portions 11 and thereby sealing means 32 is rotatably mounted to housing 29 which forms part of jacket 2. Sealing means 32 includes a resilient frusto-conical seal member 32*a*, a narrower end of which faces away from a first end 10*a* of outer passage 9. Sealing means 32 also includes a two part housing 33, 34 which are mounted together by threaded portion 35. Housing 33 has a recess 36 in which a wider end of seal 32*a* is located and an annular shoulder 37 of seal 32*a* is engaged by housing 34 thereby sandwiching a wider end of seal 32*a* between housings 33, 34.

Figure 3:
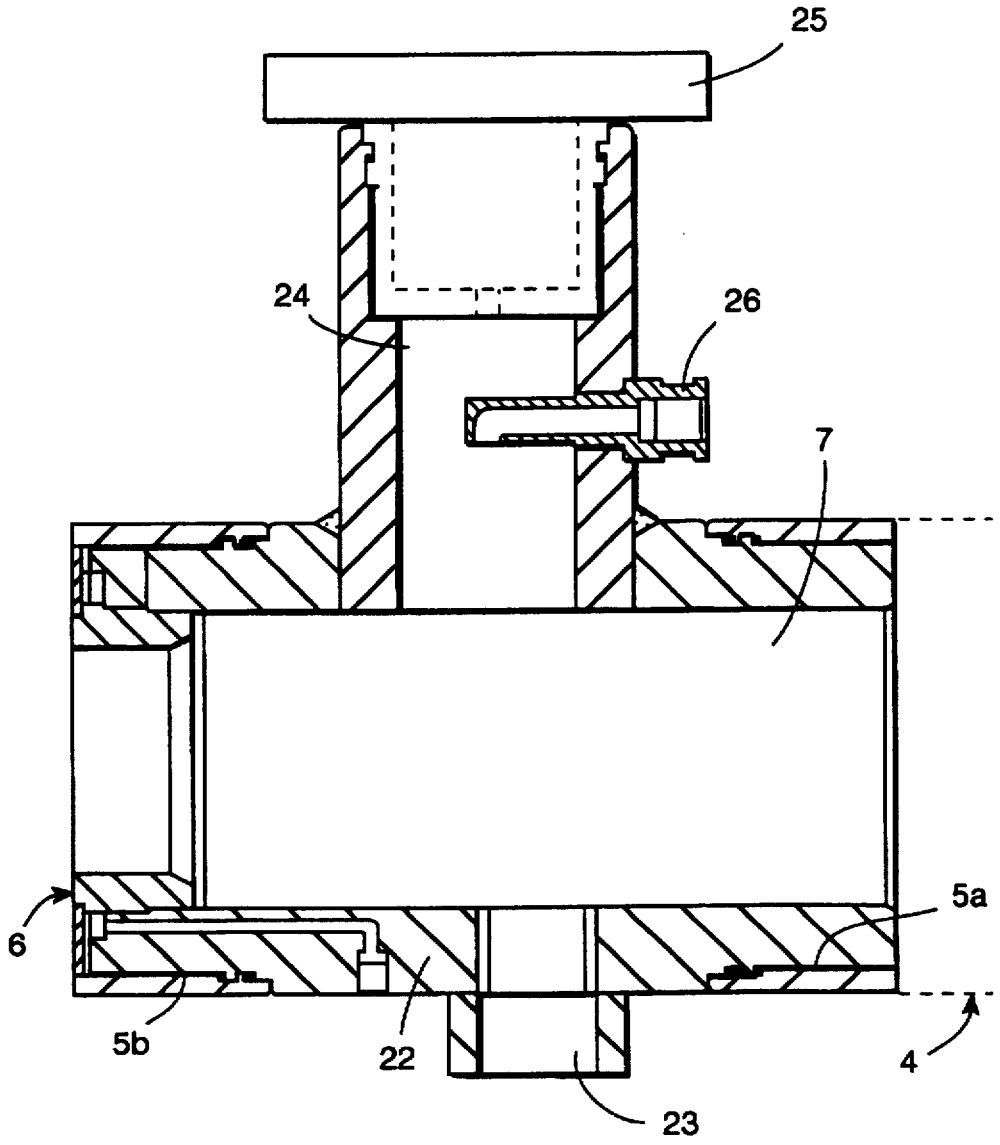
FIG. 3 is an enlarged cross-sectional view of an intermediate assembly section of the assembly of FIG. 1.

Intermediate assembly is shown in detail in FIG. 3 and consists of an outlet housing 22 having an inlet port 23 for entry of hydraulic fluid under pressure from a fluid pressure supplying system 12. Outlet housing 22 also has an outlet port 24 to which a pressure regulator 25 is mountable. A pipe elbow 26 allows a collecting container in the form of a cylinder 13 (FIG. 1) to be in selective communication with outer passage 9.

Intermediate assembly section 5 is attached at its end to first assembly section 4, and to second assembly section 6, respectively. The attachments being by threaded engagements 5*a*, 5*b* and appropriate seals.

Figure 4:
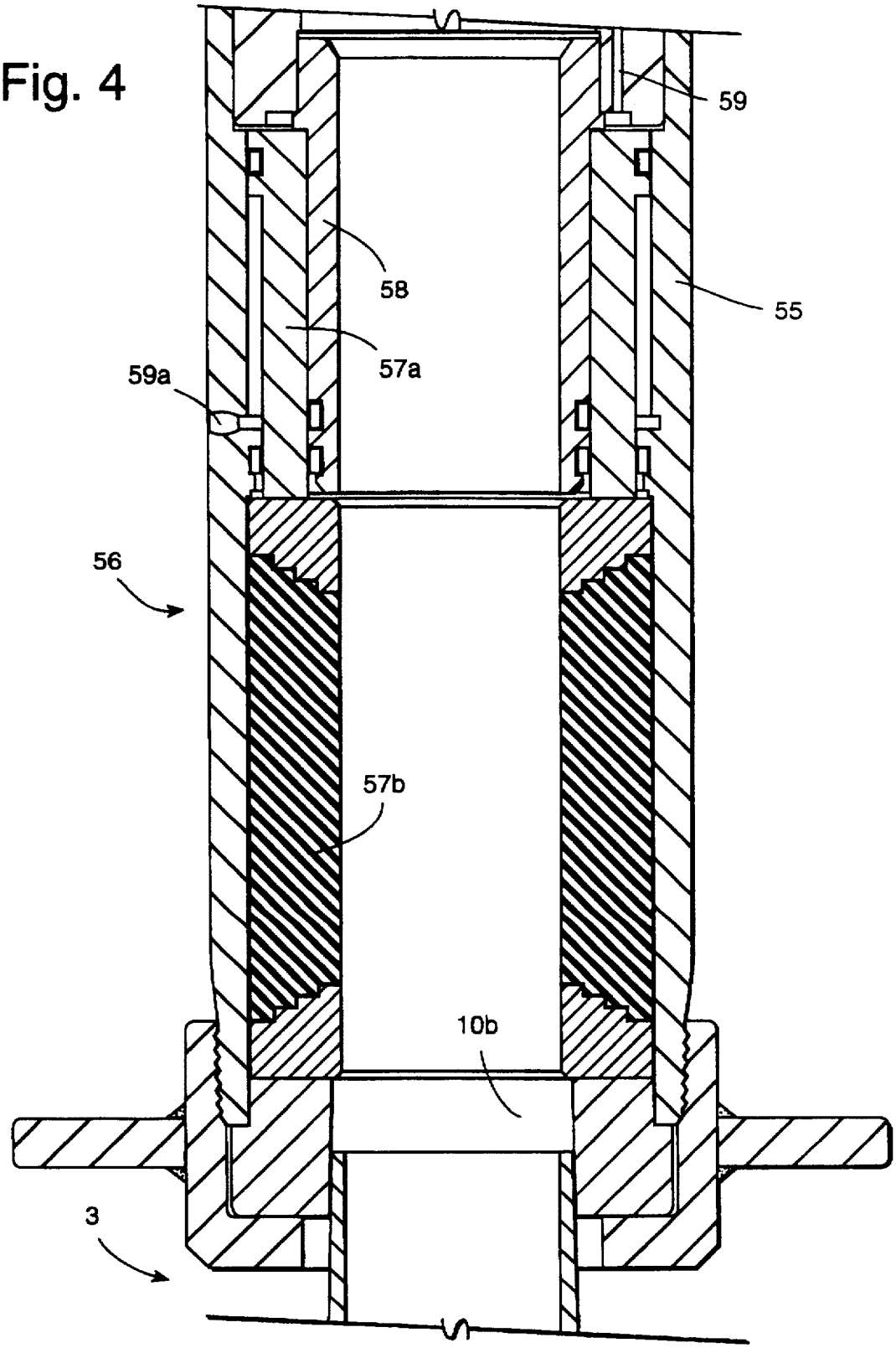
FIG. 4 is an enlarged cross-sectional view of second assembly section of the assembly of FIG. 1.

Second assembly 6 is shown in more detail in FIG. 4 and includes a housing 55 and outer passage valve 56 which includes a resilient member 57*b* for selectively engaging an outer surface of drilling rod 8 (not shown in FIG. 4) to seal a second end 10*b* of outer passage 9. Valve 56 is actuated by a piston 57*a* adapted to reversibly slide upon a lower spindle 58 in which a vent 59*a* provides pressure equalisation during actuation of piston 57*a*. The position of piston 57*a* is determined by hydraulic fluid pressure applied through an operating port 59. Piston 57*a* is sealed between housing 55 and spindle 58 by hydraulic seals and bears on resilient member 57*b*. Hydraulic pressure applied through operating port 59 causes the piston 57*a* to compress resilient member 57*b* thereby forming an inner seal at the wellhead and 10*b* of outer passage 8*a* as shown particularly in FIG. 7. As illustrated second assembly 6 is mounted, in use, to drill casing 3.

As best shown in FIG. 1, cylinder 13 is in selective communication with outer passage 9 via valves 14, 15 and pipes 16, 17 which are attached to the outlet of pipe elbow 26. Pipes 16, 17 are releasably coupled together by connector 18. An outlet piping assembly which is in filtered communication through filter 20 with cylinder 13, has a bleed valve 40, pressure gauge 41, outlet valve 42 and hose tail 43.

Fluid pressure supplying system 12 includes a means (not shown) for providing pressurised hydraulic fluid, a directing valve 44 for directing hydraulic fluid along either hoses 45 or 46. Hose 45 is connected to inlet port 23 wherein hose 46 is connected to hydraulic swivel 47 which has a threaded spigot 48 for engagement with an end of drilling rod 8. Rig 49 is positioned to grip or support or rotate or advance or retract rod 7 when required.

Assembly 1, in use is mounted to drill casing 3 which has a ball valve 51 which is closed when drilling rods 8 are removed from the borehole. In use, directing valve 44 is adjusted to allow pressurised hydraulic fluid to flow through swivel 47 which supplies rod 8 and all the other coupled rods forming a drill string in the borehole. The hydraulic fluid flows down hydraulic supply passage 8*a* to the working end of the drill rod string which may include all or any of the following; bit, jetting assembly, downhole motor, at the bottom of borehole 52.

The hydraulic fluid carries formation fragments and fluid which are pumped up the borehole 52 in a passage between the borehole wall and rod 8, into outer passage 9 via (via second end 10*b*) and through outlet port 24 for disposal. Pressure of the hydraulic fluid can be adjusted, if required, by pressure regulator 25.

Seal 32*a* slidably engages outer surface of rod 8, thereby during drilling rod 8 may move into borehole 52 whilst providing a seal preventing the pressurised fluid from flowing out of end 10*a*. Due to drill rod seal 32 being rotatably mounted to jacket 2, rotation of rod 8 causes sealing means to also rotate which therefore reduces wear on seal 32*a*.

Figure 6:
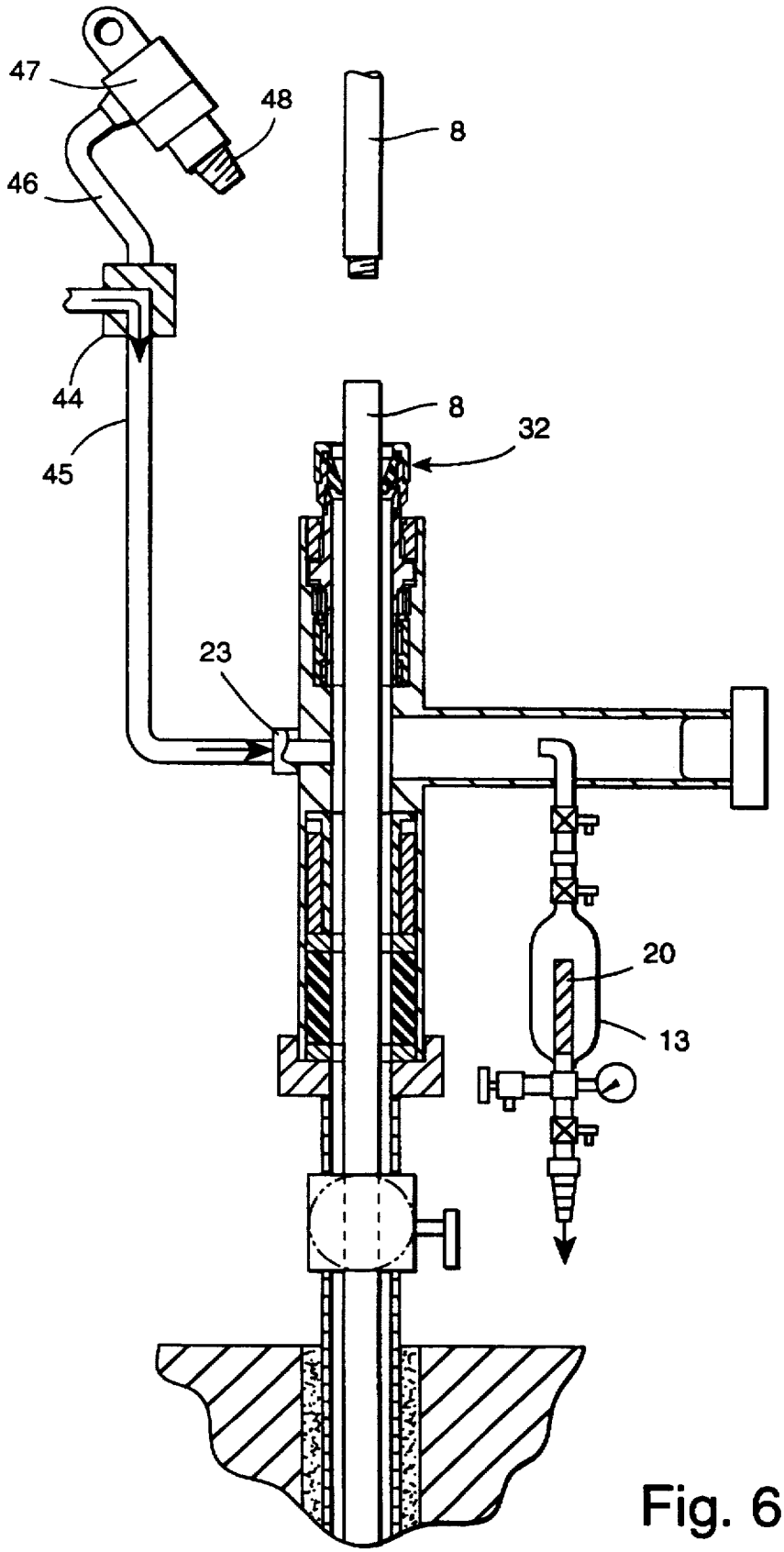
FIG. 6 shows schematically the operation of inserting a rod into the assembly of FIG. 1.

Referring to FIG. 6, when a further rod 8 is required to be coupled to other rods 8, to increase the length of the drill string, directing valve is adjusted to allow the hydraulic fluid to flow through inlet port 23 whilst swivel 47 and rod 8 are uncoupled. Accordingly, a hydraulic pressure maintaining means is provided to maintain hydraulic pressure in borehole 52 in which the pressurised hydraulic fluid is pumped into outer passage 9 and a check valve associated with supply passage 8*a* stops the fluid from flowing from the bottom of borehole 52 and out of uncoupled rod 8. The check valve may be a separate valve or it could be in the form of a downhole motor.

Once a further rod 8 has been coupled to increase the length of the drill string swivel is coupled to further rod 8 and valve 44 is adjusted so that hydraulic fluid flows to swivel 47.

Figure 7:
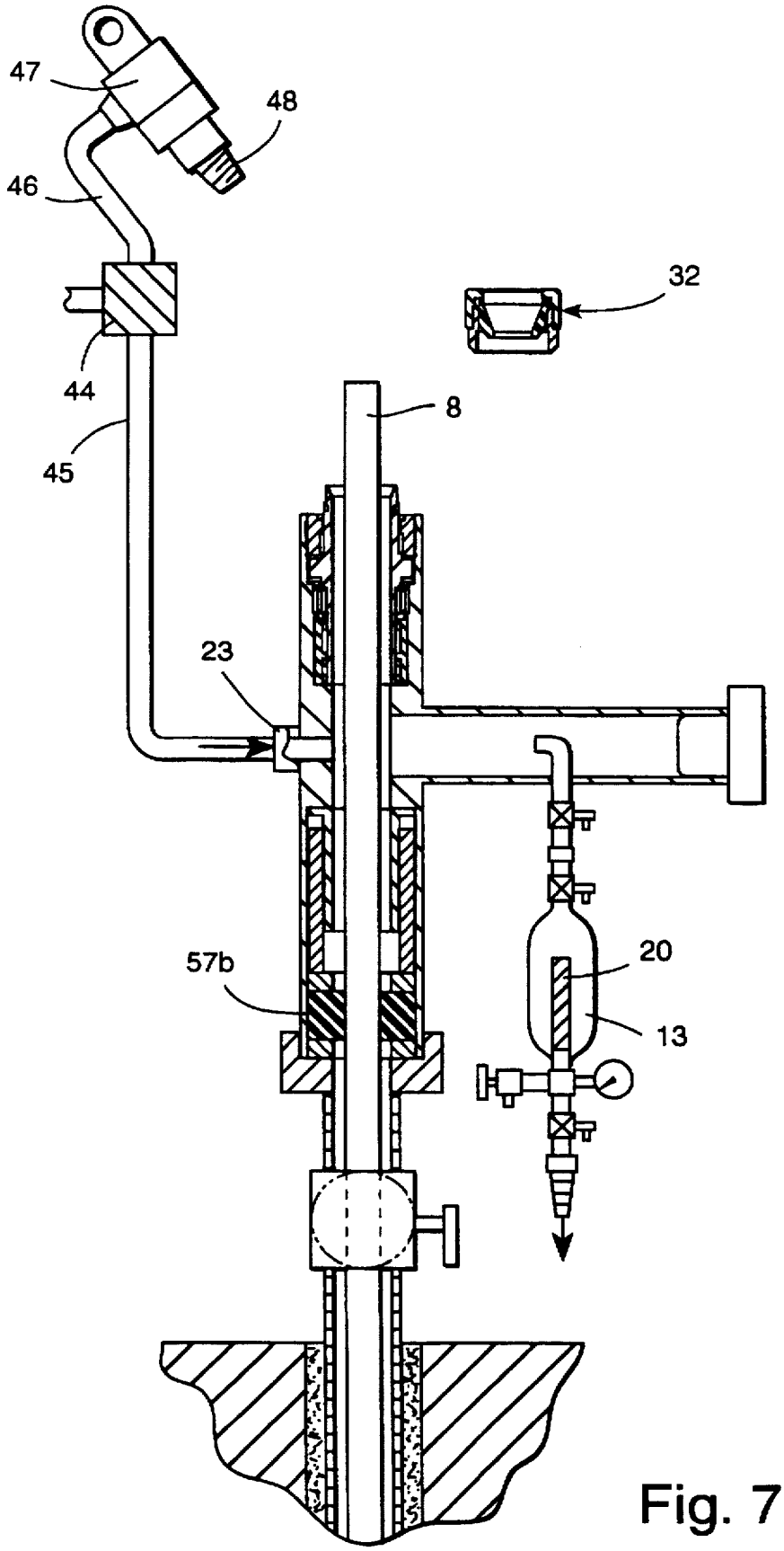
FIG. 7 shows schematically the operation of replacing a drill rod seal of FIG. 1.

FIG. 7 shows how the resilient member 57*b* of the valve 56 can be used to seal against the rod 8 thereby allowing replacement of the drill rod seal 32 or pressure regulator 25; However, if required, valve 56 may be used in addition to or as an alternative pressure maintaining means to inlet port 23. When used as a pressure maintaining means, pressure is maintained in the borehole by valve 56 sealing outer passage 9 in combination with the check valve associated with the supply passage.

Figure 5A:
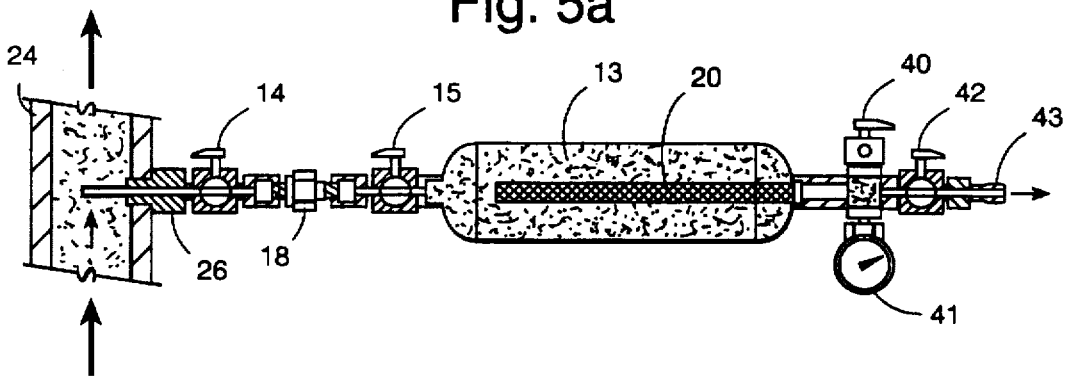
FIG. 5*a*–5*c* are enlarged schematics of a collecting container of FIG. 1 illustrating selective valve usage for carrying out various sampling operations.
Figure 5B:
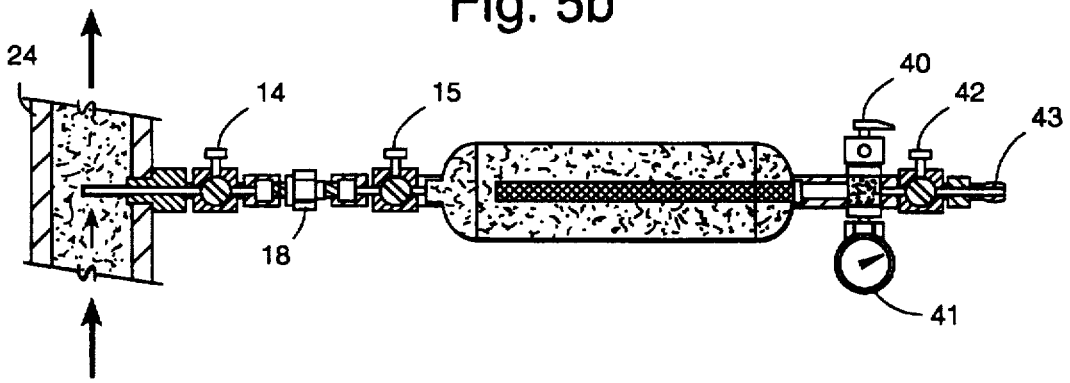
Figure 5C:
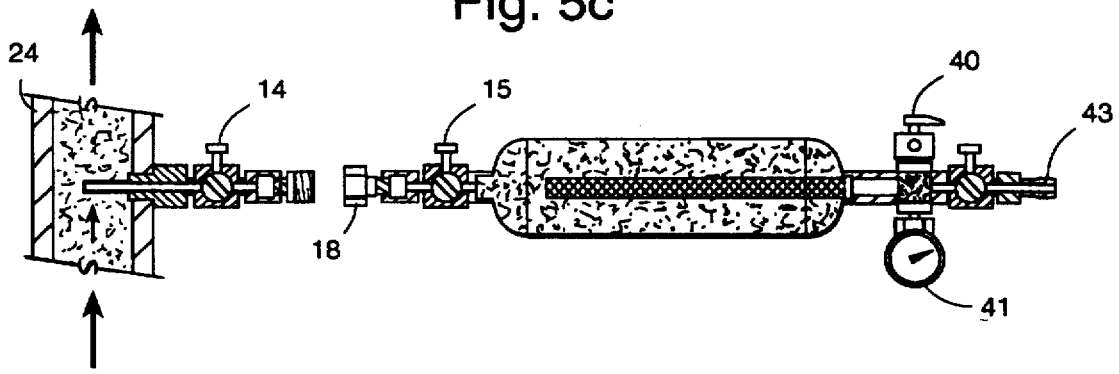

Referring to FIGS. 5*a* to 5*c*, the method of collecting a formation sample at pressure is illustrated in which the drilling of the formation is not interrupted. As shown in FIG. 5*a* valves 14 and 15 are fully opened and outlet valve 42 is partly opened. Accordingly, samples comprising the formation and formation fluid along with pressurised hydraulic fluid are allowed to enter cylinder 13 along with pressurised hydraulic fluid, thereby collecting the sample for analysis.

As shown in FIG. 5*b* outlet valve 42 is then closed after which valves 14 and 15 are then closed thereby collecting the sample at pressure. If required and illustrated in FIG. 5*c* cylinder 13 may be removed by disconnecting union connector 18 and the sample in cylinder 13 may be analysed in due course whilst the first cylinder can be connected at connector 18.

Figure 8:
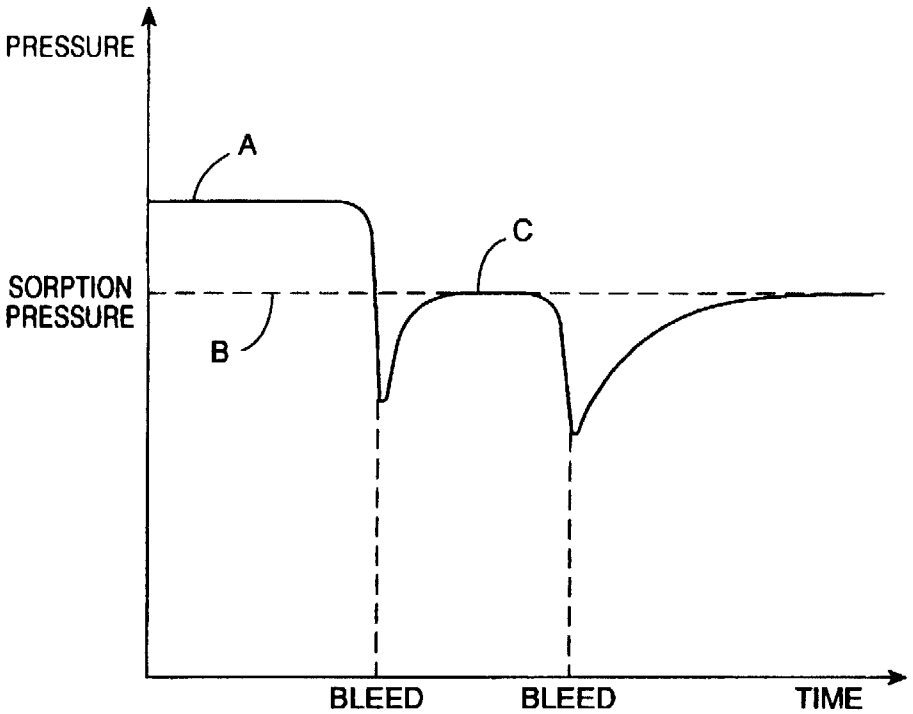
FIG. 8 is a graph showing how the assembly of FIG. 1 can be used to detect formation gas sorption pressure or formation bubble point.

As illustrated specifically in FIG. 8 the formation gas sorption pressure or formation bubble point can be determined in which the pressure indicated at level A is the initial pressure of the sample in cylinder 13. An amount of sample pressure is bled form cylinder 13 through bleed valve 40 until the pressure is reduced below sorption pressure or the bubble point (indicated at B). The bleed valve is then closed and the sample pressure then rises to a stable value as indicated at C. This stable value being indicative of the sorption pressure or bubble point.

For small bleed volumes, the sample will de-gas and the pressure will rise to approach the formation sorption pressure or the formation fluid bubble point (i.e. when analysing gas containing formation fluids as in oil drilling or alternatively, when drilling groundwater or geothermal wells). For a small bleed volume, the pressure will be very close to the sorption pressure. As illustrated further bleeds can be carried out to confirm for the result.

Outlet valve 43 may be opened thereby reducing the sample pressure which is measured by connecting a hose and measuring cylinder to hose tail 43. As a result the volume of gas released can be measured for use in analysis of the formation.

Figure 9:
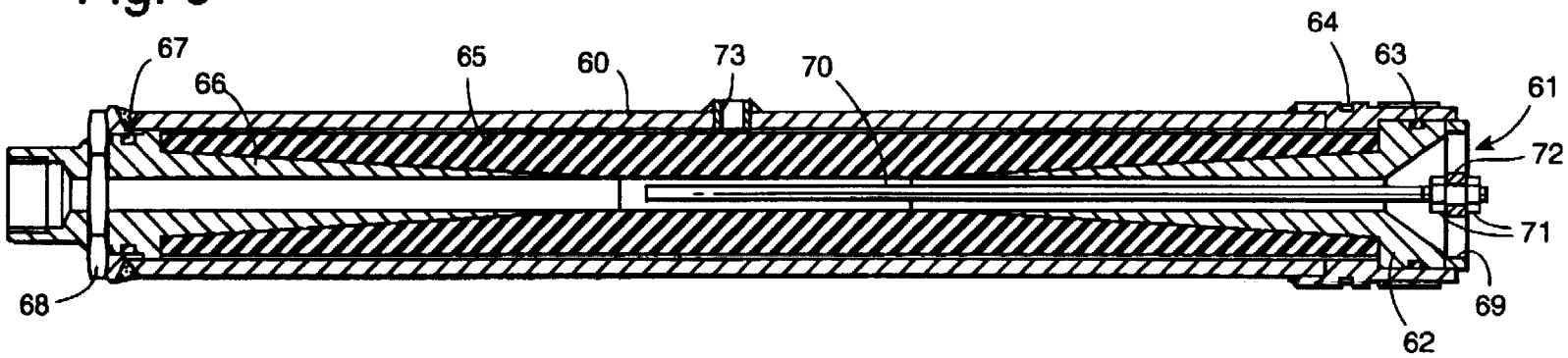
FIG. 9 is an assembly drawing of a preferred form of regulator in section.

FIG. 9 shows an embodiment of the preferred form of pressure regulator consisting of a tubular outer housing 60 attached to the intermediate assembly (FIG. 3), in place of the regulator shown as 25 in FIG. 3, at its inlet port 61 and sealed therein by seal 64. Within the outer housing is an inlet elastomer pipe attachment 62 which is sealed from the outer housing 60 by a seal 63 and which supports the elastomer regulator element 65 which is in turn connected the outlet elastomer pipe attachment 66 and which is in turn sealed by a seal 67 into the outer housing 60 and held by a lock nut 68. Bearing on the inlet elastomer attachment 62 and fixed in place by coupling to the intermediate assembly is a rod support 69 with ports for fluid flow which carries a central rod 70 through the elastomer pipe 65. The central rod 70 is coupled into the rod support 69 by a flexible coupling 72 to prevent fatigue of the rod. The outer housing 60 includes an operating port trough which pressurised fluid may move, thus actuating the elastomer pipe 65.

Although the invention has been described with reference to a preferred embodiment it is to be understood that the invention is not limited the specific embodiment herein described. For example, depending upon the type of drill string and drill motor, drill rod seal 32 may not necessarily be rotatably mounted to jacket 2 as rod 8 to which drill rod seal 32 seals need not rotate in use.

I claim:

1. Apparatus for permitting sampling of borehole drilling fluid at a pressure above that otherwise existing at a wellhead comprising:

a jacket attachable to the wellhead and through which in use can pass a drill rod which carries pressurized drilling fluid to the working end of the drill rod and out into the annulus of the borehole, the jacket having a drill rod seal at a location spaced from the wellhead and an outlet port leading from the interior of the jacket to a pressure regulator, whereby return fluid with any entrained particles or seam fluid from a drilled formation passes back into the jacket and on out through the outlet port and the pressure regulator and thence to waste, wherein the regulator comprises an annular space through which fluid can flow from an inlet to an outlet, which annular space is defined between an inner rod and a surrounding elastomer pipe which in use is squeezed radially inwards towards the inner rod by fluid pressure maintained between the outside of the elastomer pipe and a surrounding housing, and a sampling system in communication with the outlet port at a location upstream of the regulator, the sampling system intercepting a proportion of the drilling fluid passing to the regulator for enabling sorption pressures, gas contents, bubble points or other characteristics of the return fluid and entrained contents to be determined.

2. Apparatus as claimed in claim 1 wherein the elastomer pipe is reinforced with strengthening filaments to prevent it from being excessively distorted longitudinally and forced through the surrounding housing.

3. Apparatus as claimed in claim 1 wherein the regulator is constructed to fully shut down without imposing damaging internal strains on the elastomer pipe due to the presence of the internal rod.

4. Apparatus as claimed in claim 1 wherein the regulator is constructed to fully shut down on chips or cuttings in the return fluid without severe damage to the elastomer pipe by reason that these particles tend to break down during compression on the inner rod.

5. Apparatus as claimed in claim 1 wherein the sampling system comprises an inlet valve leading into a pressure vessel containing gauze on which particles entrained in the fluid can be retained, and also comprising an outlet value, a bleed valve, and pressure sensing system.

6. Apparatus as claimed in claim 1 the jacket at the wellhead end contains a resilient member which can be compressed to engage and form an inner seal around the drill rod.

7. Apparatus as claimed in claim 6 whereby the entire borehole may be shut in by use of the inner seal to permit servicing of the pressure regulator and the drill rod seal.

8. Apparatus for permitting sampling of borehole drilling fluid at a pressure about that otherwise existing at a wellhead comprising:

a jacket attachable to the wellhead and through which in use can pass a drill rod which carries pressurized drilling fluid to the working end of the drill rod and out into the annulus of the borehole, the jacket having a drill rod seal at a location spaced from the wellhead and an outlet port leading from the interior of the jacket to a pressure regulator, whereby return fluid with any entrained particles or seam fluid from a drilled formation passes back into the jacket and on out through the outlet port and the pressure regulator and thence to waste, auxiliary ducting permitting the drill rod to be changed whilst maintaining drilling fluid flow into the jacket and out through the regulator thus freeing the need for the regulator to shut down on particle-laden return drilling fluid; and a sampling system in communication with the outlet port at a location upstream of the regulator, the sampling system intercepting a proportion of the drilling fluid passing to the regulator for enabling sorption pressures, gas contents, bubble points or other characteristics of the return fluid and entrained contents to be determined.

* * * * *